US012371899B2

(12) United States Patent
Querejeta

(10) Patent No.: US 12,371,899 B2
(45) Date of Patent: Jul. 29, 2025

(54) BRICK CLIP TO BUILD DOUBLE WALLS IN A CONSTRUCTION SITE

(71) Applicant: Mauro Nicolas Querejeta, San Martin de los Andes (AR)

(72) Inventor: Mauro Nicolas Querejeta, San Martin de los Andes (AR)

( * ) Notice: Subject to any disclaimer, the term of this patent is extended or adjusted under 35 U.S.C. 154(b) by 210 days.

(21) Appl. No.: 18/088,734

(22) Filed: Dec. 26, 2022

(65) Prior Publication Data

US 2024/0209624 A1 Jun. 27, 2024

(51) Int. Cl.
*E04B 2/00* (2006.01)
*E04B 2/02* (2006.01)

(52) U.S. Cl.
CPC ..... *E04B 2/02* (2013.01); *E04B 2002/0202* (2013.01)

(58) Field of Classification Search
CPC ..... E04B 2/00; E04B 2/02; E04B 2002/0202; E04B 2002/0213; E04B 2002/0223; E04B 2002/0243
See application file for complete search history.

(56) References Cited

U.S. PATENT DOCUMENTS 5,337,530 A * 8/1994 Beames ..... E04F 13/085 52/564
5,533,839 A * 7/1996 Shimada ..... E02D 29/0233 405/286
5,845,448 A * 12/1998 Potvin ..... E04B 2/30 52/568
7,461,490 B2 * 12/2008 Toledo ..... E04B 2/16 52/293.3
9,206,999 B2 * 12/2015 Reed ..... F24S 25/70
9,605,402 B2 * 3/2017 Taylor ..... E02D 29/0233
10,718,108 B2 * 7/2020 Dean ..... E04B 2/44
2001/0029717 A1 * 10/2001 Spakousky ..... E04B 2/8617 52/745.1
2004/0006945 A1 * 1/2004 Price ..... E04B 2/06 52/169.12
2007/0245678 A1 * 10/2007 Bonelli ..... E04B 1/4185 52/698
2011/0000161 A1 * 1/2011 Aube ..... E04B 2/46 52/745.1

* cited by examiner

*Primary Examiner* — Chi Q Nguyen

(57) ABSTRACT

A brick clip to build double walls in a construction site, comprising a base from one face of which at least two projections capable of being inserted into the holes of a hollow brick are projected. The base is flat and has an X shape defining two right side arms and two left side arms. At each end of the arms of the X-shaped base a cylindrical projection protrudes, and at the center of the X-shaped base two parallel elongated projections protrudes. The cylindrical projections of the right side arms are inserted into the holes of one hollow brick, the cylindrical projections of the left side arms are capable of being inserted in the holes of another hollow brick, and the elongated projections are capable of defining a separation partition that keep the distance between the two bricks.

4 Claims, 8 Drawing Sheets

BRICK CLIP TO BUILD DOUBLE WALLS IN A CONSTRUCTION SITE

FIELD OF THE INVENTION

The present invention is related to construction materials and methods, and more particularly to a brick clip a construction worker may use to easily make a double-wall brick in the construction site without adding extra costs.

BACKGROUND OF THE INVENTION

The double wall has been used to build energy efficient homes for a long time. While there are many ways to do it, the basic premise is to build one structural wall (typically the inside wall), build a second wall around it, and fill the space between with insulation.

With a double brick design, there is a small gap between the two layers of brick that make up the home's foundation and structure. This space functions as a great way to properly insulate the home and slow the process of thermal transition. Because of this, the temperature inside the home will naturally be at a comfortable level without much help from your thermostat.

During summer, when it is hot outside, the walls absorb the heat and allow less of it to make it inside the home. And during winter, a similar effect occurs with warm air staying inside while cold air is absorbed by the walls and buffer space. This natural insulation will aid in reducing the monthly bill and saving on energy in the home.

Double-wall construction is considered to be "above grade", or in other words, a premium wall design. Many homeowners and builders choose the double-wall design because it offers more structural integrity and for its exceptional energy performance. Homes with this feature are known to use less electricity and heat. Overtime this can save the homeowner a lot of money. And since energy costs only seem to be going up, this can be a great way to build savings right into a home.

Some other advantages to double-wall construction involve excellent air/vapor barrier support and noise reduction. The way the wall materials are layered creates a more consistent and reliable air/vapor barrier and the additional materials and wall thickness prevent less noise from traveling through the walls.

Double-wall construction has several advantages over a conventional stick-frame wall: it provides more room for insulation, reduces thermal bridging through the studs, and avoids moisture problems that can arise from using vapor-impermeable materials like foam board.

There has been tested and designed several different double-wall techniques. The key to this system is good air sealing (so warm air is not lost through the wall) and placing enough insulation outside the air barrier so the structural wall sheathing so that it stays warm and dry.

The main purpose of the present invention is to present a simple light cheap clip that can be used to build double walls simplifying the construction technique and without adding extra costs. There are bricks in the market to make a double wall but they are heavy, difficult and expensive to transport and handle in the construction site.

SUMMARY OF THE INVENTION

It is a main purpose of the present invention a brick clip to build double walls in a construction site, comprising a base from one face of which at least two projections capable of being inserted into the holes of a hollow brick are projected.

It is also a purpose of the present invention a brick clip wherein the base is flat and has an X shape defining two right side arms and two left side arms. At each end of the arms of the X-shaped base a cylindrical projection protrudes, and at the center of the X-shaped base two parallel elongated projections protrudes. The cylindrical projections of the right side arms are inserted into the holes of one hollow brick, the cylindrical projections of the left side arms are inserted in the holes of another hollow brick, and the elongated projections are capable of defining a separation partition that keep the distance between the two bricks.

It is also a purpose of the present invention a clip made out of one of the following materials: plastic, wood, metal, cardboard, rubber.

It is also a purpose of the present invention a method to define a hollow brick unit for building a double wall in a construction site, comprising:

- laying two hollow bricks next to each other, parallel along their longitudinal axis, with a regular space between them;
- providing two X-shaped brick clips including each a flat base with four cylindrical projections and two elongated projections projected therefrom,
- arranging one clip in front of one of the ends of the two above-cited bricks so that two projections of the clip face two holes in the first brick, and the other two projections face two holes in the other brick attached next to it,
- making a blow on the smooth rear face of the clip making the four projections of the clip insert at the same time into the holes of the two bricks;
- arranging the second clip in front of the opposite ends of the two bricks so that two projections of the clip face two holes in the first brick, and the other two projections face two holes in the other brick laid next to it,
- making a blow on the smooth rear face of the clip making the four projections of the clip insert at the same time into the holes of the two bricks;
- the elongated projections of each clip define a separation partition between the two bricks.

It is also a purpose of the present invention a double wall brick unit, comprising:

- two hollow bricks next to each other, parallel along their longitudinal axis, with a regular space between them;
- a first clip inserted at one end of each brick, wherein the first clip includes a base, four cylindrical projections and two elongated projections; the two cylindrical projections of the first clip are inserted in the holes of one brick and two cylindrical projections of the same first clip are inserted in the wholes of the other brick,
- the elongated projection of the first clip defines a separation partition between both bricks;
- a second clip is inserted at the opposite end of each brick, wherein the second clip also includes a base, four cylindrical projections and two elongated projections;
- two cylindrical projections of the second clip are inserted in the holes of one brick and two cylindrical projections of the same second clip are inserted in the holes of the other brick, and
- the elongated projection of the second clip defines a separation partition between both bricks.

One or more of the above-disclosed embodiments, in addition to certain alternatives, are provided in further detail below with reference to the attached figures. The disclosed subject matter is not, however, limited to any particular embodiment disclosed.

DETAILED DESCRIPTION OF THE INVENTION

Figure 1:
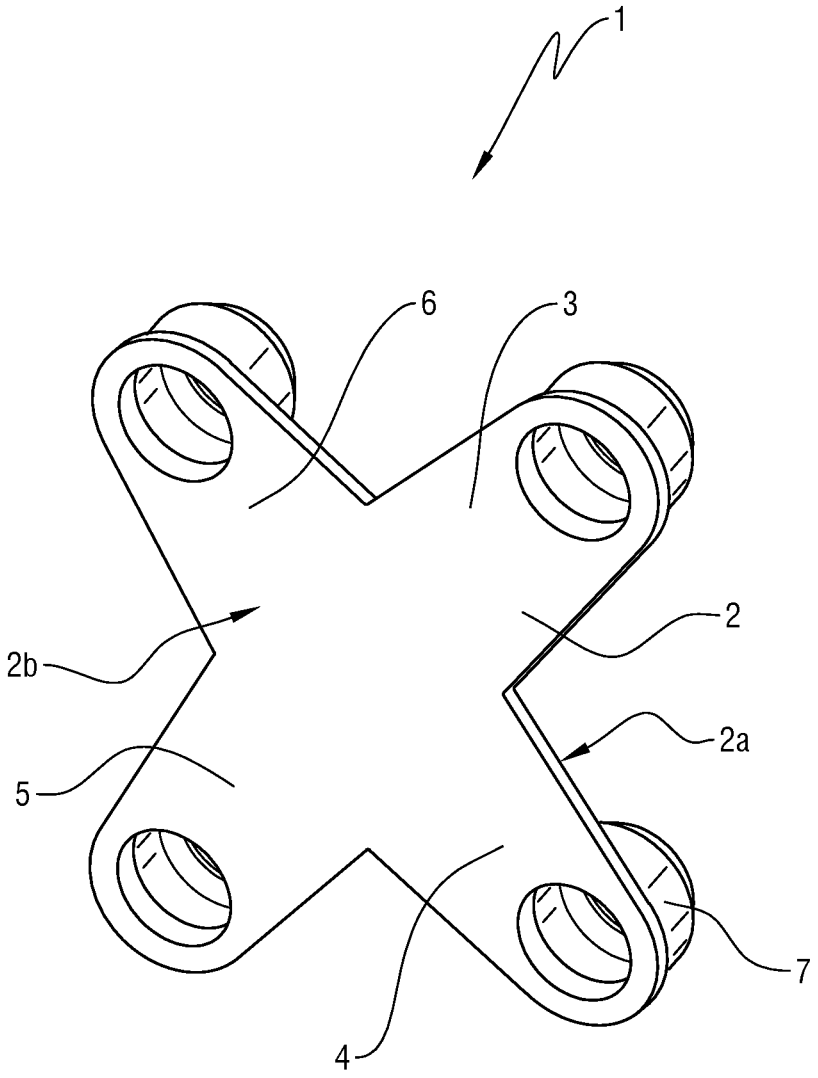
FIG. 1 is a general front perspective view of the clip in accordance to the present invention.
Figure 2:
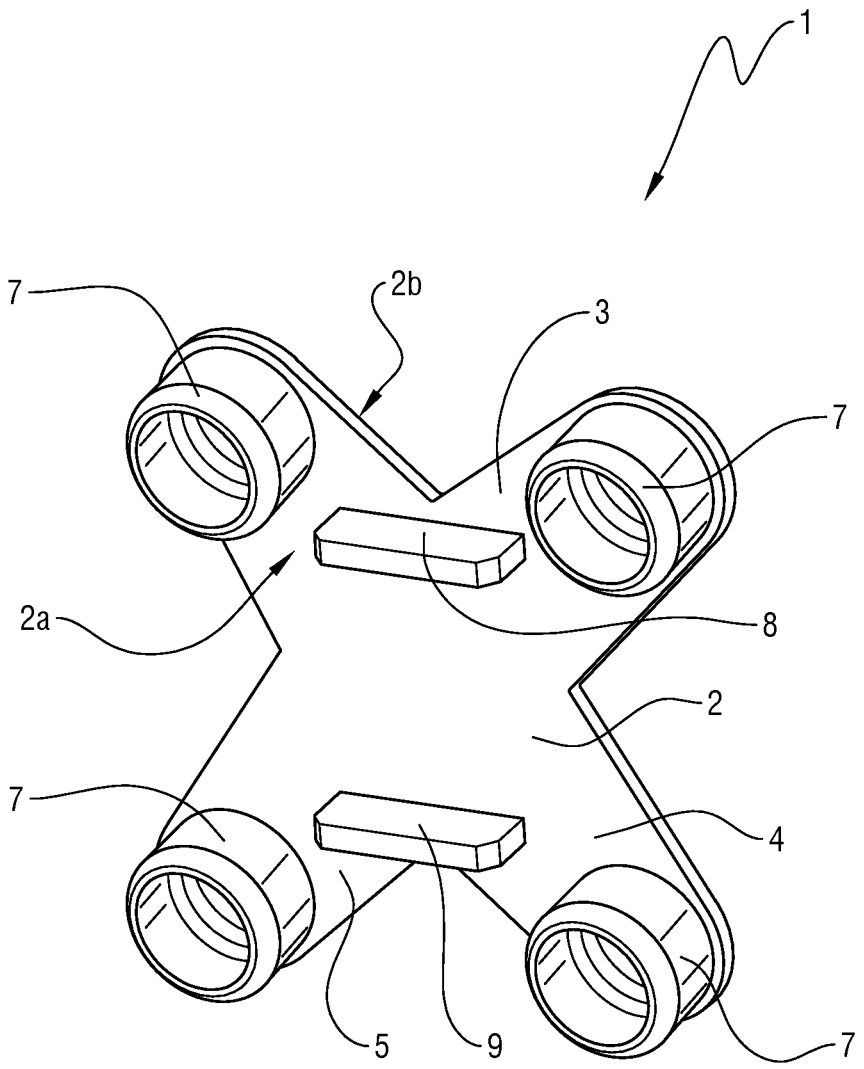
FIG. 2 is a general back perspective view of the clip in accordance to the present invention.
Figure 3:
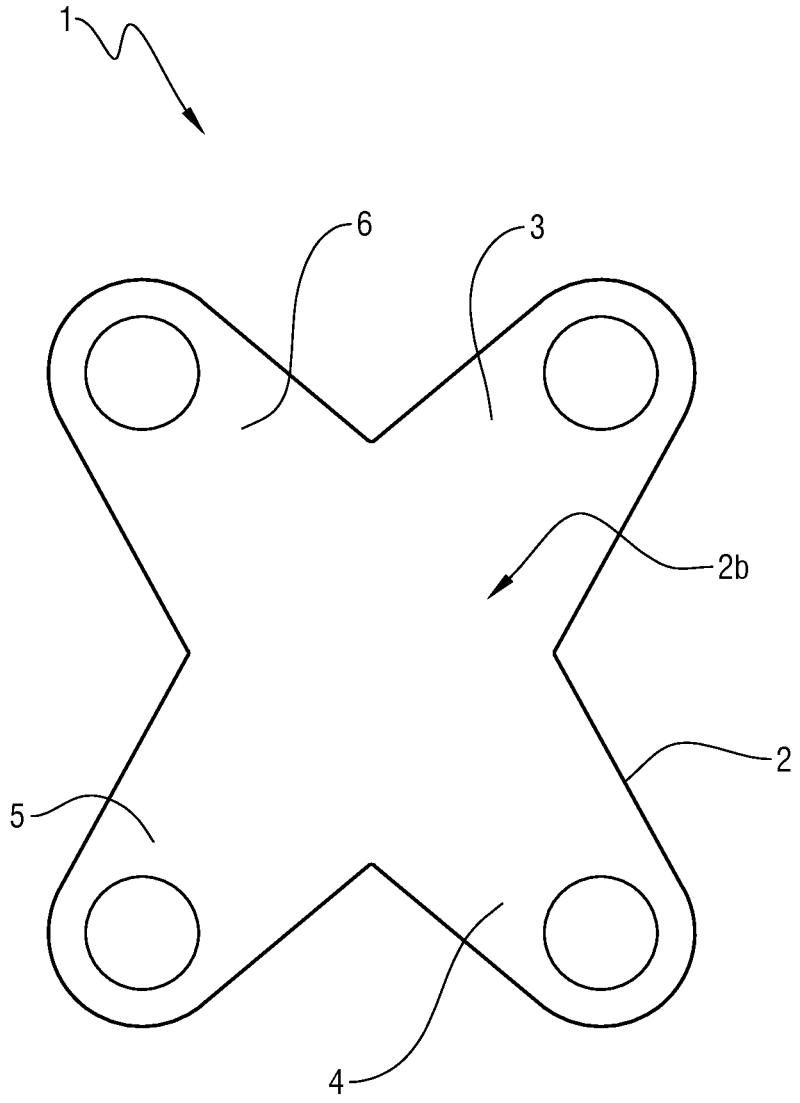
FIG. 3 is a top plan view.
Figure 4:
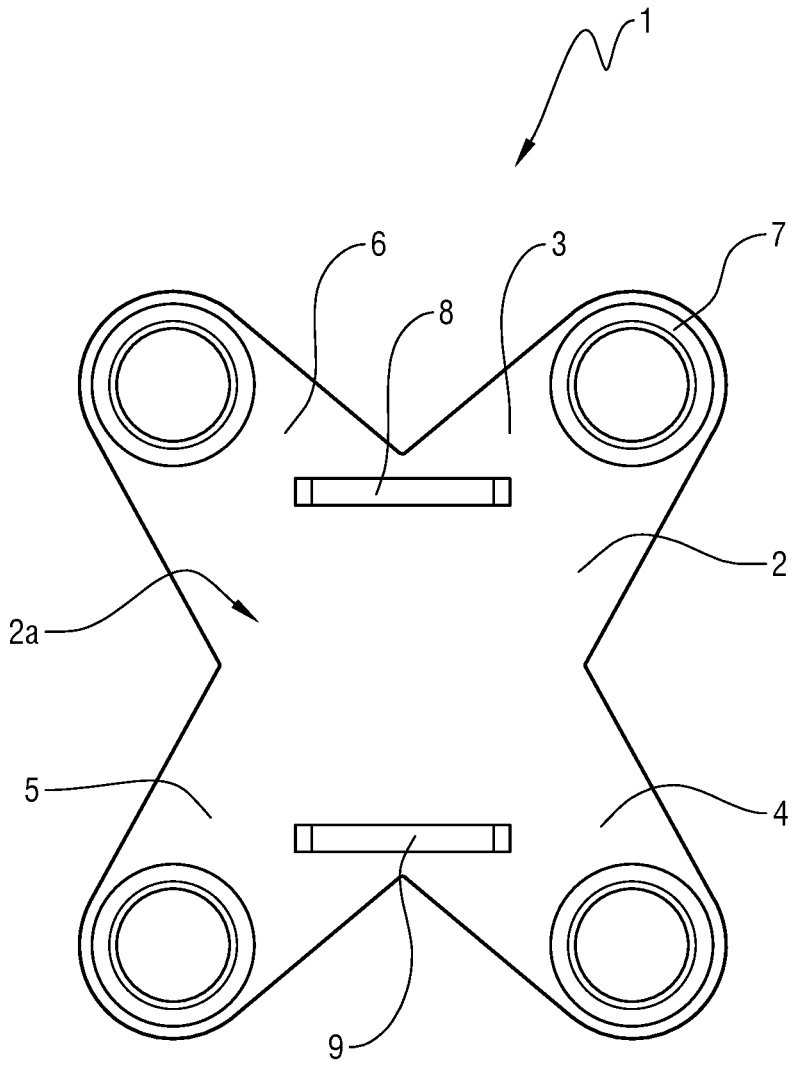
FIG. 4 is a bottom plan view.
Figure 5:
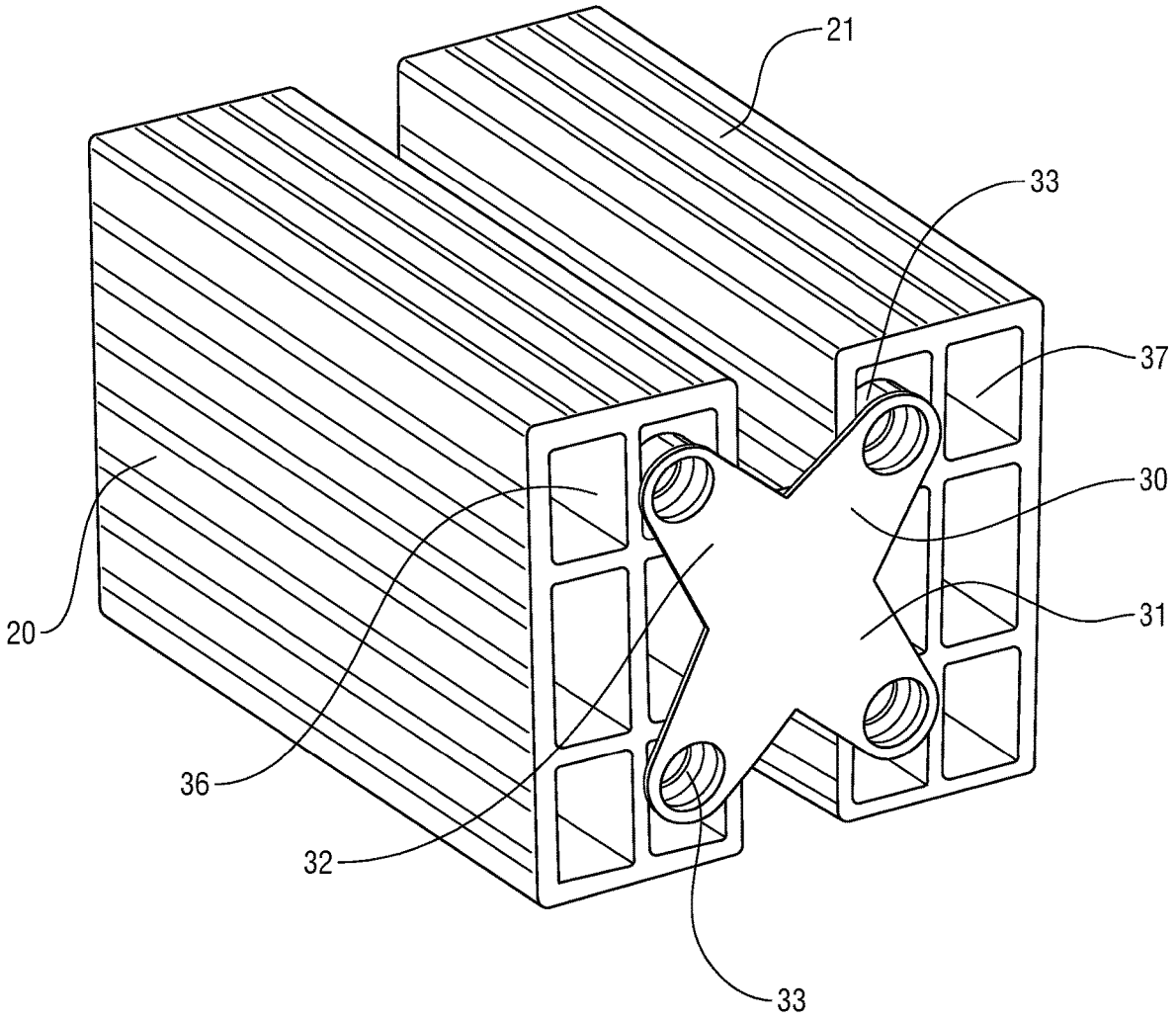
FIG. 5 is a general perspective view of the clip in accordance to the present invention already clipped to a regular hollow brick
Figure 6:
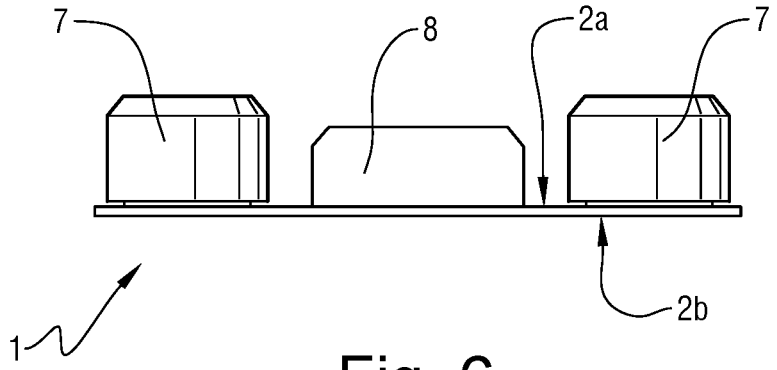
FIG. 6 is a side elevational view.
Figure 7:
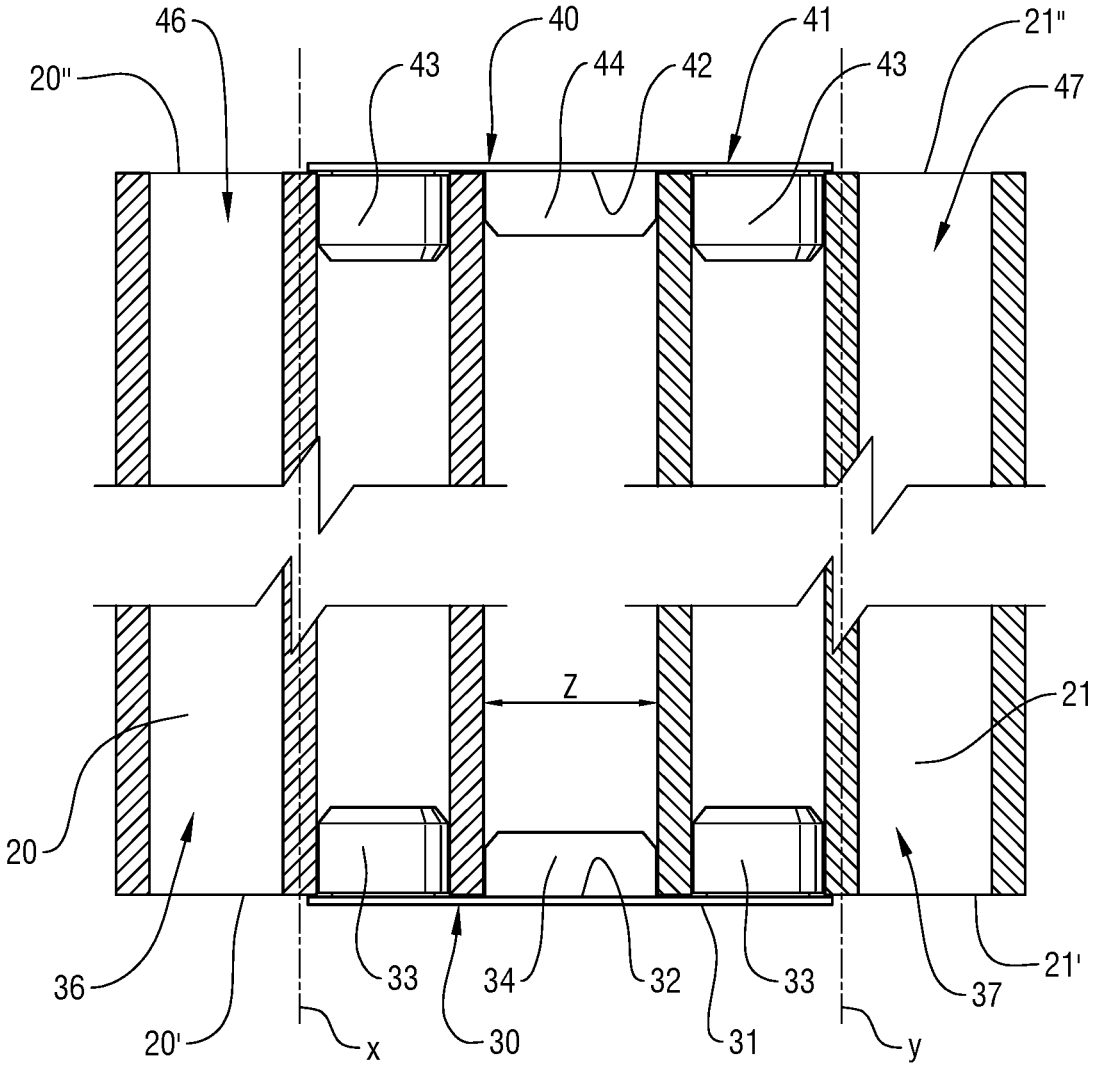
FIG. 7 is a cross sectional view of a brick with a clip installed on both ends.
Figure 8:
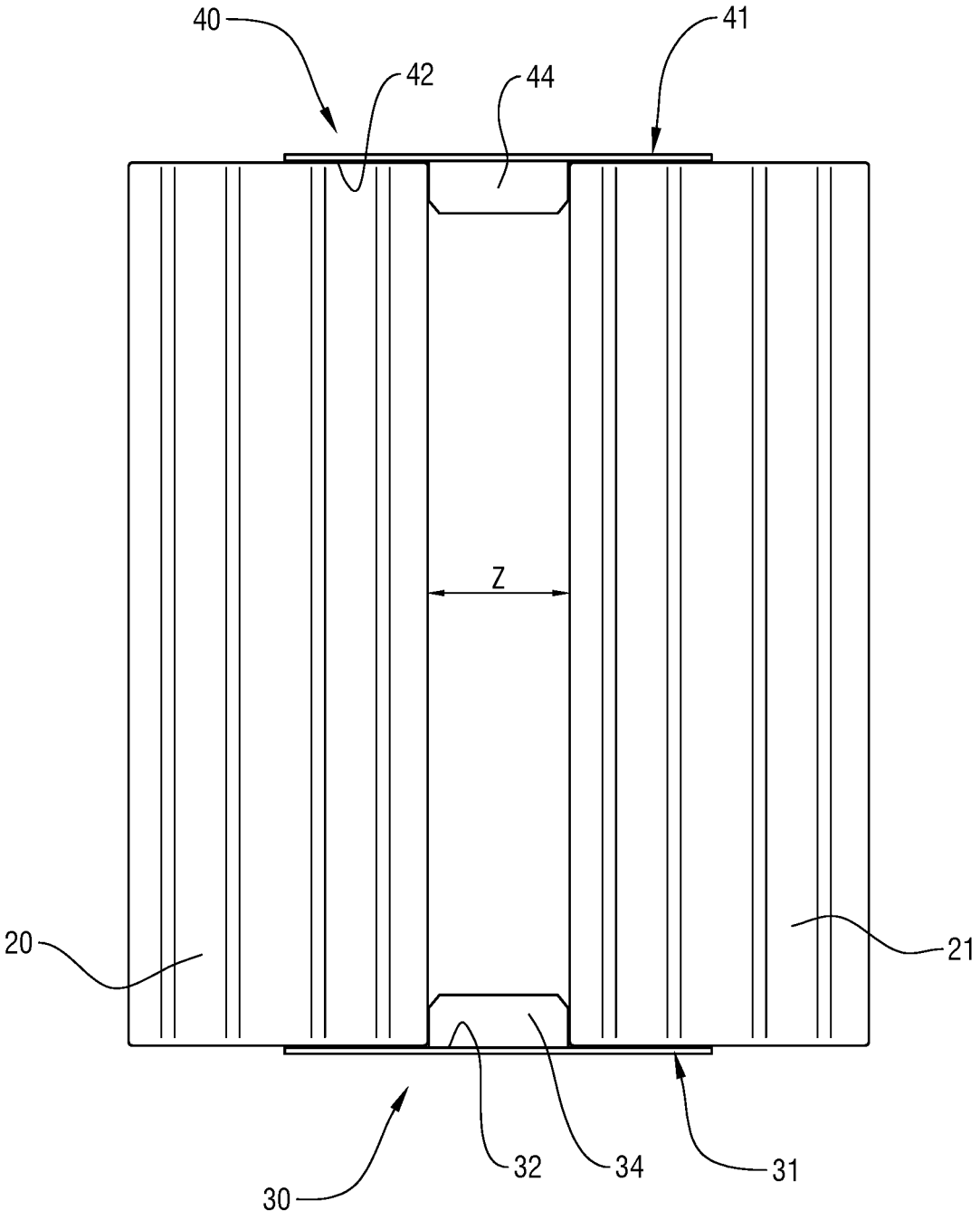
FIG. 8 is a side elevational view of the brick with two clips installed in both ends.
Figure 9:
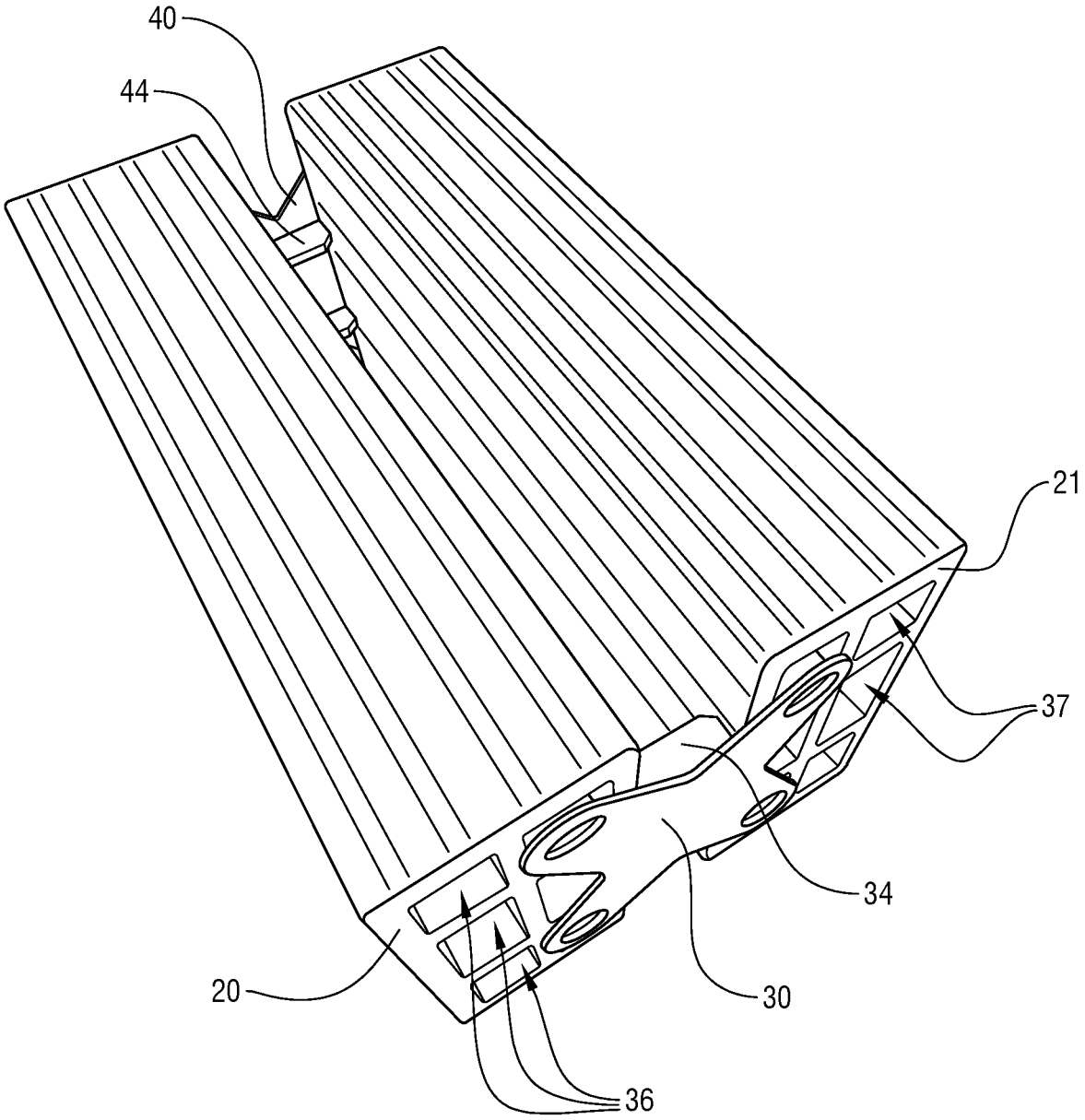
FIG. 9 is a general perspective view of a brick with two clips installed in both ends.

The brick clip 1, in accordance with the present invention, comprises a flat X-shaped base 2 with a front face 2*a* and a back face 2*b*. Said X-shaped base defines two right arms 3-4 and two left arms 5-6. At the end of each arm 3-6 a cylindrical projection 7 protrudes from the front face 2*a* of the flat base 2. Each projection 7 has a diameter that corresponds to the size of the holes of the bricks into which this projection is inserted as it will be explained in detailed below.

On the same front face 2*a* of the base 2 two elongated parallel projections 8-9 also protrudes. These projections 8-9 will define a separation partition to keep two bricks separated between each other with a predefined distance as it will be explained in detailed below.

The brick clip 1 may be used to make a double wall brick in the construction site by a construction worker. The steps a construction worker takes to make a double wall brick using the clip of the present invention defines a method to define a hollow brick unit for building a double wall in a construction site, comprising:

a) laying two hollow bricks 20-21 next to each other, parallel along their longitudinal axis X-Y, with a regular space Z between them;

b) providing two X-shaped brick clips 30-40 including each a flat back face 31-41 and a front flat face 32-42 with four cylindrical projections 33-43 and two elongated projections 34-44 projected therefrom, c) arranging the clip 30 in front of the end 20'-21' of the two above-cited bricks 20-21 so that two projections 33 of the clip 30 face two holes 36 in the first brick 20, and the other two projections 33 face two holes 37 in the other brick 21, d) make a blow on the smooth rear face 31 of the clip 30 making the four projections 33 of the clip 30 insert at the same time into the holes 36-37 of the two bricks 20-21;

e) arranging the second clip 40 in front of the opposite ends 20"-21'" of the two bricks 20-21 so that two projections 43 of the clip 40 face two holes 467 in the first brick 20, and the other two projections 43 face two holes 47 in the other brick 21, f) make a blow on the smooth rear face 41 of the clip 40 making the four projections 43 of the clip 40 insert at the same time into the holes 46-47 of the two bricks 20-21;

g) the elongated projections 34-44 of each clip 30-40 define a separation partition between the two bricks.

In one of the preferred embodiments of the brick clip 1 in accordance with the present invention it is made out of plastic, as it is easy to mold or inject, it is light, easy and safe to handle and cheap to manufacture. Hundred of clips may be shipped to the construction site in a plastic bag, and the workers may easily manipulate them to maker the double wall bricks in the spot. This is much easier and cheaper than manufacturing, shipping, and handling the bricks used in the art to make a double wall. This may not be interpreted as a limitation of the scope of protection of this invention, as those skilled in the art may easily recognize the clip may also be made using different materials, including but not limited to wood, metal, cardboard, rubber, etc.

In the attached drawings the clip 1 is shown as a flat X-shaped piece with two arms 3-4 on one side and two arms 5-6 on the other side, but any the shape may be used, including but not limited to square, rectangular, circular, oval, etc. The X-shaped is optimal in terms of minimizing the amount of material used to manufacture the clip, and thus reducing the cost, but any other shape may also be used.

What is claimed is:

1. An X-shaped brick clip to build double walls in a construction site, comprising an X-shaped base, the X-shaped base having a center, a face, a first right side arm, a second right side arm, a first left side arm, a second left side arm, said first right side arm having an end, said second right side arm having an end, said first left side arm having an end, said second left side arm having an end, a first projection protruding from said end of said first right side arm, a second projection protruding from said end of said second right side arm, a third projection protruding from said end of said first left side arm, a fourth projection protruding from said end of said second left side arm, and two parallel elongated projections at the center of the base and extending from the face.

2. The X-shaped brick clip of claim 1, wherein each of said first, second, third and fourth projections has a cylindrical shape.

3. The X-shaped brick clip of claim 2, wherein said cylindrical shape projections of said first right side arm and said second right side arms are capable of being inserted into holes of a first hollow brick, said cylindrical shape projections of said first left side arm and said second left side arms are capable of being inserted in the holes of a second hollow brick, and said first, second, third and fourth projections are capable of defining a separation partition that maintains a distance between said first and second hollow bricks.

4. The X-shaped brick clip of claim 1, wherein said X-shaped brick clip is made out of a material selected from plastic, wood, metal, cardboard, rubber.

* * * * *